United States Patent [19]

Anderson et al.

[11] 4,054,769

[45] Oct. 18, 1977

[54] MICROWAVE OVEN INTERLOCK SWITCH SAFETY

[75] Inventors: Carl L. Anderson; John T. Lamb, both of Mansfield, Ohio

[73] Assignee: The Tappan Company, Mansfield, Ohio

[21] Appl. No.: 663,904

[22] Filed: Mar. 4, 1976

[51] Int. Cl.[2] ..... H05B 9/06

[52] U.S. Cl. ..... 219/10.55 C; 337/126

[58] Field of Search ..... 219/10.55 C, 10.55 B; 337/5, 15, 123, 125, 126, 140, 157; 200/DIG. 28

[56] References Cited

U.S. PATENT DOCUMENTS

| | | | |
|---|---|---|---|
| 2,354,933 | 8/1944 | Winborne | 337/126 |
| 3,340,374 | 9/1967 | Shiraishi et al. | 337/126 |
| 3,497,839 | 2/1970 | Jakobs | 337/140 X |
| 3,699,300 | 10/1972 | Buerki | 219/10.55 C |
| 3,857,067 | 12/1974 | Zanboorie | 219/10.55 C |
| 3,968,380 | 7/1976 | Jost et al. | 337/140 X |
| Re. 28,822 | 5/1976 | Fritts | 219/10.55 C X |

*Primary Examiner*—Arthur T. Grimley

*Attorney, Agent, or Firm*—Donnelly, Maky, Renner & Otto

[57] ABSTRACT

A protector switch is added in the power supply to open on failure of the door interlock switch to open when the oven door is opened. The monitor switch that closes as the door opens, after the door switch should open, will if the latter does not occur create a power short-circuit ahead of the oven; in this circuit there is a heat responsive electrical resistance element that mechanically holds the protector switch closed against a switch opening bias. Such element will fail under the short circuit current and release the protector switch to shut off the power to the oven. The resistance element can be a wire of predetermined resistance, with current limiting capability, or an off-the-shelf control resistor.

10 Claims, 5 Drawing Figures

MICROWAVE OVEN INTERLOCK SWITCH SAFETY

This invention relates to a safety control for microwave ovens.

The domestic microwave oven is, at least in a commerical sense, a relatively new home appliance that brings into the home kitchen a very substantially different type of cooking energy, namely, magnetron generated microwave energy to which the housewife or other user of the oven might theoretically be exposed with possible harmful effect. Because of this, such ovens have been subjected to very extensive private and non-private research and testing, with the formulation of strict requirements for safety that have been more than adequately met in the ovens approved to date for sale. For example, since the high frequency energy permeates the cooking cavity during operation and there must be a door for access, one area that has been given considerable attention has been the sealing of the door against leakage, with multiple redundancy or seals in fact provided.

It is equally important that power to the oven be assuredly prevented unless the door is in its closed and properly sealed condition, for example, to eliminate energy in the cavity should the user open the door for any reason before a cooking cycle that has been programmed has been terminated and the power shut off by the controller. Microwave ovens thus have door interlock switches mechanically coupled to the door and operative in the power circuit to provide this particular safety feature. Moreover, a back-up to the door switch has also been provided to interrupt the power in the unlikely, but theoretically possible, event that the door switch fails to operate properly, and this has been accomplished by a monitor switch, also directly or indirectly responsive to door movement, that operates to create a short circuit ahead of the oven to blow a fuse in the power circuit. Another proposal on the same order employs a monitor switch controlled auxiliary heater to destruct a fuse or open a thermostatic switch for the same purpose.

With the deliberate short circuit condition thus used for the added safety, there are two factors to consider in its application. The first is the obvious desirability that its interruptive action be quickly effective, and the second, which possibly has not been as appreciated, is the fact that even for the short interval that it exists, the electrical shorting of the power supply produces a high current flow that could damage other components of the system. In the above simple fuse arrangement, the reaction time can be very short, but there is little resistance to the current flow. On the other hand, the thermostat and auxiliary heater control does have current limiting effect, but is relatively slow-acting and, moreover, is not a destruct means that guarantees servicing of the oven, which is desired in view of the original door interlock failure.

It is, accordingly, a primary object of the present invention to provide such a microwave oven door interlock safety that has both satisfactory response time and helpful short-circuit current resistance.

Another object of the invention is to provide such a safety that is either self-destructive or irreversible so that it is incapable or re-use without repair or replacement.

It is an additional object of the invention to provide safety means for such a power switch failure that requires for its operative assembly only commercially availabel inexpensive components.

Other objects and advantages of the present invention will become apparent as the following description proceeds.

To the accomplishment of the foregoing and related ends the invention, then, comprises the features hereinafter fully described and particularly pointed out in the claims, the following description and the annexed drawing setting forth in detail a certain illustrative embodiment of the invention, this being indicative, however, of but one of the various ways in which the principle of the invention may be employed.

Figure 1:
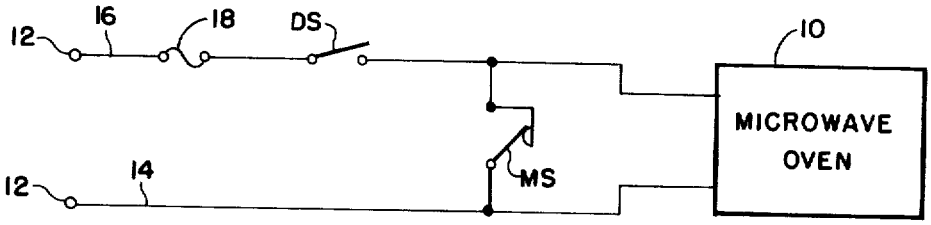
FIG. 1 (PRIOR ART)
FIG. 1 illustrates schematically a prior art interlock switch safety for a microwave oven.
Figure 2:
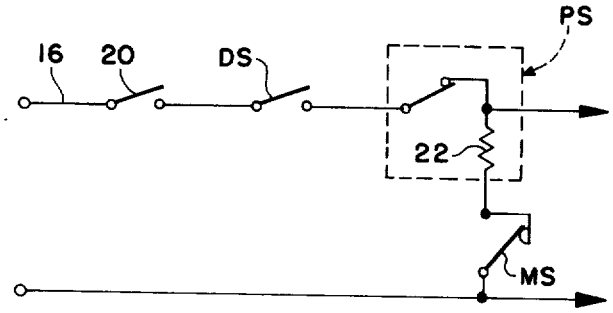
FIG. 2 is a line diagram of one form of the present invention.

Referring now to the drawing in detail, the microwave oven 10 is of course of conventional form, with the invention as earlier indicated concerned with its door interlock safety switch, and especially the means for monitoring such switch to overcome failure to the same to open, as it should, whenever the oven door is opened. This safety feature as shown in FIG. 1 as it has been provided in the prior art, with the power supply for the oven appearing at the terminals 12 and one power line 14 directly connected to the oven electrical system.

The door interlock switch DS is in the other power line 16, also including a fuse or fusible element 18, and such closed door switch is mechanically actuated by the usual door latching mechanism to open the switch when the latch mechanism is actuated to release the door for opening. The open monitor switch MS is also mechanically interlocked to the door, in such manner that it is closed when the door physically moves a small distance in the opening direction.

According to this prior art teaching, then, if interlock switch DS fails to open by the time that monitor switch MS is closed, the circuit connection of the latter directly across the power lines created a short circuit of high current flow and fuse 18 melts to open the power line 16.

According to the present invention, the power line 16, with an oven on-off switch 20 also shown, includes the same or an equivalent door interlock swich DS as above described. A second safety or protector switch PS is, however, added in series in the same line, and a fusible wire resistance 22 of predetermined value is in the short circuit of the also similar monitor switch MS.

Figure 3:
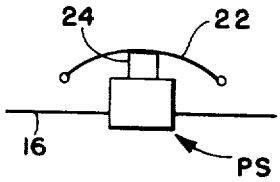
FIG. 3 is a partial elevation of components in the FIG. 2 circuit.

The fusible resistance wire 22 and the protector switch PS are of the physical form and relation shown in FIG. 3 in a first component assembly, with the switch of known snap-acting type and having a plunger 24 that is depressed to close its contacts. The resistance wire extends over the plunger and is anchored in suitable manner at its ends under tension sufficient to hold the plunger down and the switch therefore normally closed. With this control, if the oven door switch DS remains closed when the door is unlatched preparatory to opening, the delayed closing of monitor switch MS causes short circuit current to flow as before, but as some lesser value due to the resistance of the wire 22 to fuse the latter, whereupon the switch PS quickly releases to open the power line.

The resistance wire 22 instead of being a straight wire, in effect, could also obviously be of coil or other shape and similarly perform its function. Furthermore, actual disruptive fusion is not essential, although preferred here, since such a resistance wire, of any usable shape, could be made to irreversibly deform or stretch, for example, under the contained spring force on the switch plunger enough to release the switch when the wire attains a given operating temperature due to the current flow.

Figure 4:
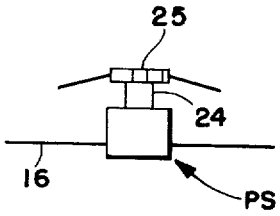
FIG. 4 illustrates another component alternative to that shown in FIG. 3.

In FIG. 4, the protector switch PS is the same, snap-acting, but a standard off-the-shelf rated resistor 25 has been substituted for the resistance wire. This resistor use for the fusible hold-down has comparative advantages over the resistance wire, such as its extreme availability and the ease with which it can be mounted or installed. Such an element is, of course, rated in the usual manner, and its value relatively precisely selected to balance the point of rupture and the desired current limiting effect in the circuit. Moreover, such a resistor element ruptures or fails without any spark or explosive effect. For these reasons, it is believed that such resistor hold-down could be considered preferable to the resistance wire.

Figure 5:
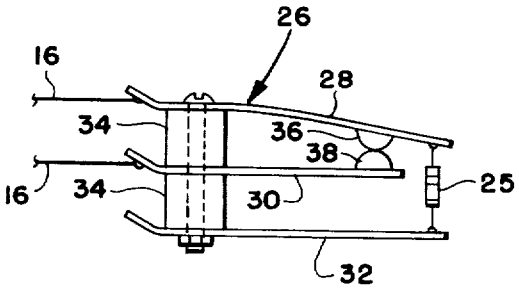
FIG. 5 shows another component variation also usable in accordance with the invention.

The control resistor 25 is also usable for comparable result with other types of switches, such as the stacked blade switch 26 shown in FIG. 5. This switch is also a common variety, with the one shown having three contact blades 28, 30, and 32, respectively superimposed and spaced laterally apart by insulator blocks or pads 34. For the action desired in this invention, the top blade 28 is highly flexible and carries a contact button 36 for engagement with a like facing button 38 at the end of the middle blade 30. The control resistor 25 has its leads secured to the top blade and the botttom blade at a tensioning length such that it normally deflects the top blade as shown enough for contact between the two buttons. The control resistor will be connected in the monitor switch circuit as previously set forth and, in this case, when it ruptures as a result of the short circuit current, the top blade is released to quickly open the contacts.

Other commercially available types of switches might be used as well, with the snap-action or quick opening a common preference, and in the stack switch of FIG. 5, it would obviously be possible to use one with a second set of contacts operated simultaneously with the first to open both the power lines to the oven. For that matter, stack switches having even more contacts might be usable for added switching functions in the complete microwave oven circuit under the control of the resistor 25.

We claim:

1. In a microwave oven having door interlock switch means in the oven power supply and monitor switch means, the two switch means being respectively sequentially opened and closed in response to opening of the oven door, the monitor switch means being between the oven and in the interlock switch means to short-circuit the power supply upon closing if the interlock switch means fails to open with power supplied to the oven; protector switch means also in the oven power supply, the contacts of said protector switch means being normally open, actuator means for forcibly and releasably closing said contacts, and heat deformable electrical resistance means mechanically acting on said actuator means to hold the same in switch closing condition, said heat deformable means being in circuit with said monitor switch means to receive current flow through the latter, such flow of current being sufficient to rapidly deform the resistance means sufficiently to release the actuator means and thereby interrupt the supply of power to the oven.

2. The invention as set forth in claim 1, wherein said electrical resistance means comprises a taut wire hold-down for said actuator means.

3. The invention as set forth in claim 2, wherein said wire is made of a material that fuses at a selected temperature due to the monitor switch means current through the same.

4. The invention as set forth in claim 1, wherein said electrical resistance means is a control resistor that mechanically holds said actuator means in its switch closing condition.

5. In a microwave oven having door interlock switch means in the oven power supply and monitor switch means, the two switch means being respectively sequentially opened and closed in response to opening of the oven door, the monitor switch means being between the oven and the interlock switch means to short-circuit the power supply upon closing if the interlock switch means fails to open with power supplied to the oven; protector switch means also in the oven power supply, said protector switch means having resilient normally open contacts, and electrical resistance means for mechanically holding said contacts forcibly closed, said resistance means being connected in circuit with said monitor switch means and responding to current flow through the same to release the protector switch contacts, thereby interrupting the power supply to the oven in the event the door interlock switch means fails closed.

6. The invention as set forth in claim 5, wherein said electrical resistance means is a wire that deforms sufficiently by heating due to monitor switch current flow through the same to release the protector switch contacts.

7. The invention as set forth in claim 6, wherein said wire deforms in response to such current flow to the point of fusion.

8. The invention as set forth in claim 5, wherein said electrical resistance means is a control resistor of predetermined value that ruptures to release the protector switch contacts.

9. In an electrical on-off switch assembly, cooperable contacts having engaged and disengaged operating conditions, mechanically displaceable means for resiliently forcibly adjusting said contacts from one condition to another, hold-down means for constraining said displaceable means in contact adjusting displacement, said hold-down means comprising a control resistor, and means connecting said resistor in an electrical circuit for current flow therethrough, current in said circuit in excess of a preselected limit causing thermal rupture of the control resistor and consequent release of the switch contacts from said other to said one condition thereof.

10. A switch assembly as set forth in claim 9, wherein the control resistor is under tension.

* * * * *